US005119977A

United States Patent [19]

Moschini

[11] Patent Number: 5,119,977

[45] Date of Patent: Jun. 9, 1992

[54] CONTINUOUS SEMI-LIQUID CASTING PROCESS AND A FURNACE FOR PERFORMING THE PROCESS

[75] Inventor: Renzo Moschini, Senigallia, Italy

[73] Assignee: Weber S.r.l., Turin, Italy

[21] Appl. No.: 547,483

[22] Filed: Jul. 3, 1990

[30] Foreign Application Priority Data

Jul. 25, 1989 [IT] Italy ..... 67627 A/89

[51] Int. Cl.[5] ..... C21C 5/42

[52] U.S. Cl. ..... 222/590; 222/595; 266/239

[58] Field of Search ..... 266/233, 234, 239, 44, 266/236; 222/590, 595

[56] References Cited

U.S. PATENT DOCUMENTS

| | | | |
|---|---|---|---|
| 3,790,145 | 2/1974 | Gering | 266/234 |
| 3,844,453 | 10/1974 | Eickelberg | 266/234 |
| 4,638,980 | 1/1987 | Beele | 266/239 |

FOREIGN PATENT DOCUMENTS

| | | |
|---|---|---|
| 0242347 | 10/1987 | European Pat. Off. . |
| 2037634 | 7/1980 | United Kingdom . |
| 2051597 | 1/1981 | United Kingdom . |

OTHER PUBLICATIONS

New Technology Brochure entitled "Inert-Gas Shielding and Automatic Pouring of Liquid Metal for Production of Premium Quality Castings".

*Primary Examiner*—Scott Kastler
*Attorney, Agent, or Firm*—Baker & Daniels

[57] ABSTRACT

A metal alloy, in particular a light alloy, is continuously cast in the semi-liquid state by bringing it up to conditions such as to cause segregation of a solid phase within the interior of the liquid alloy and making the alloy pass through a static mixer adapted to mix the solid phase uniformly upon formation, with the liquid alloy, so as to obtain at the output from the mixer a suspension which, once solidified, provides a material with valuable microstructural characteristics; the alloy is supplied continuously to the static mixer by introducing it in a discrete manner into a sealed furnace through an externally heated barometric column and, simultaneously, by pressurizing the interior of the furnace by the introduction into it of a flow of gas at a pressure value such as to cause the said alloy to flow through the static mixer in stationary laminar conditions.

3 Claims, 2 Drawing Sheets

CONTINUOUS SEMI-LIQUID CASTING PROCESS AND A FURNACE FOR PERFORMING THE PROCESS

BACKGROUND OF THE INVENTION

The present invention relates to a process for casting a metal alloy continuously in a semi-liquid state, in particular for casting a light alloy usable for casting components of the fuel supply system of a heat engine. The invention further relates to a furnace for performing this process.

A static mixer is known from Italian Pat. No. 1,119,287 filed Jun. 20, 1979 and entitled: "Process for the preparation of a mixture comprising a solid phase and a liquid phase of a metal alloy and device for performing this process", the static mixer being of the type formed by a cylindrical casting channel within which are disposed in succession a series of helically wound blades or paddles, by means of which it is possible to cast a metal alloy by obtaining partial solidification, during casting, within the passage of the static mixer, with simultaneous mixing of the solid phase, upon formation, with the remaining liquid phase in such a way as to form at the output from the static mixer a solid/liquid mixture in which the solid phase separating out from the liquid alloy is uniformly dispersed in suspension within the liquid alloy itself. The mixture thus obtained is stable for a sufficiently long period of time to permit collection in a ladle and subsequent casting in moulds to obtain castings having particular and valuable microstructural characteristics.

To be able to obtain these characteristics, however, the solid/liquid mixture must be obtained in stationary fluid dynamics conditions and it is necessary to be able to control with precision and speed the physical and dynamic parameters of the casting (temperature gradient of cooling of the alloy, speed of transit through the static mixer, etc); this necessity involves, on the one hand, having to effect casting by the use of pressurised furnaces so that the casting cannot be performed continuously, but only as a batch process; and on the other hand it involves the necessity of rejecting not inconsiderable quantities of alloy and, above all, of having to dismantle and clean the static mixer in the interval between one casting and the next; bearing in mind that the furnaces cannot, for practical reasons, have a very high capacity (for example greater than 1000 Kg) this latter disadvantage involves high maintenance costs and, finally, a high cost per unit of cast alloy and a low overall productivity of the system.

SUMMARY OF THE INVENTION

The object of the invention is that of providing a semi-liquid casting process which makes use of the known static mixer described above but which can however be performed continuously. It is a further object of the invention to provide a furnace which can be coupled with a static mixer to perform this semi-liquid casting process continuously.

The said objects are achieved by the invention in that it relates to a continuous semi-liquid casting process in which a metal alloy in the liquid state is brought into conditions such as to produce separation of a solid phase within the body of the liquid and in which the alloy is moreover made to pass through a static mixer adapted uniformly to mix the solid phase, upon formation, with the liquid alloy in such a way as to obtain at the output from the mixer a temporarily stable suspension; characterised by the fact that it comprises the following stages:

introducing the molten alloy into a furnace through a barometric column surmounting the said furnace and dipping into the interior thereof, the interior of the said furnace being maintained closed with a fluid-tight seal and connected hydraulically to the said static mixer; and supplying the alloy continuously to the said static mixer by pressurising the interior of the furnace to a pressure value such as to cause the said alloy to flow through the said static mixer in stationary laminar conditions.

The present invention further relates to a furnace for the continuous semi-liquid casting of a metal alloy by making it pass through a static mixer connected in a fluid-tight manner to a casting aperture of the said furnace, characterised by the fact that the said furnace is sealed in a fluid-tight manner and has a monolithic refractory lining adapted to contain a fluid bath of the said alloy, the said monolithic refractory lining being formed alongside the said casting aperture, means for introducing a pressurised gas into the interior of the furnace, above the said monolithic refractory lining, and a barometric column of predetermined height surmounting the said furnace and dipping into the interior of the liquid bath.

BRIEF DESCRIPTION OF THE DRAWINGS

For a better understanding of the invention a nonlimitative description of an embodiment thereof is now given with reference to the attached drawings, in which.

DETAILED DESCRIPTION OF THE INVENTION

Figure 1:
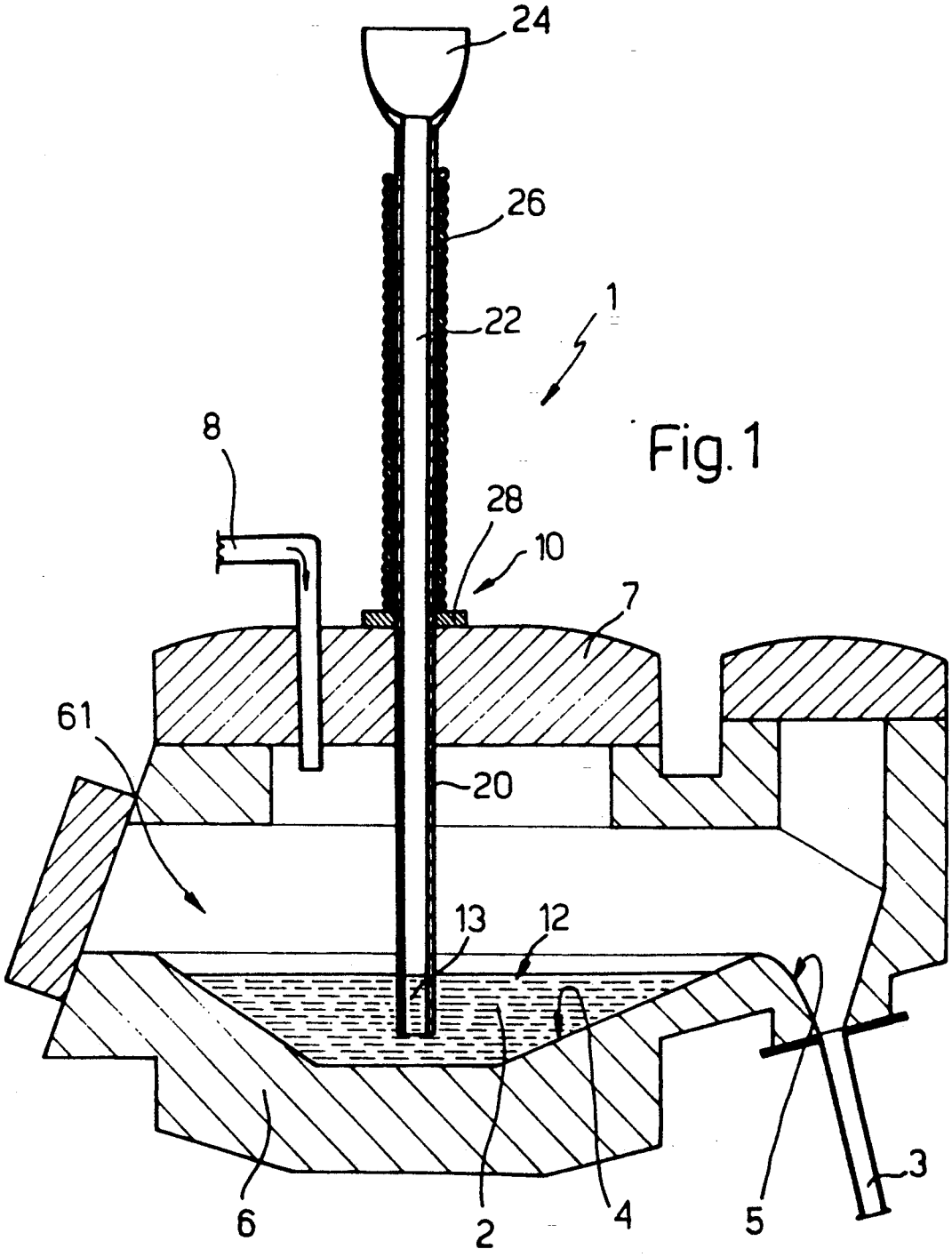
FIG. 1 illustrates a side view in section of a furnace formed according to the invention.
Figure 2:
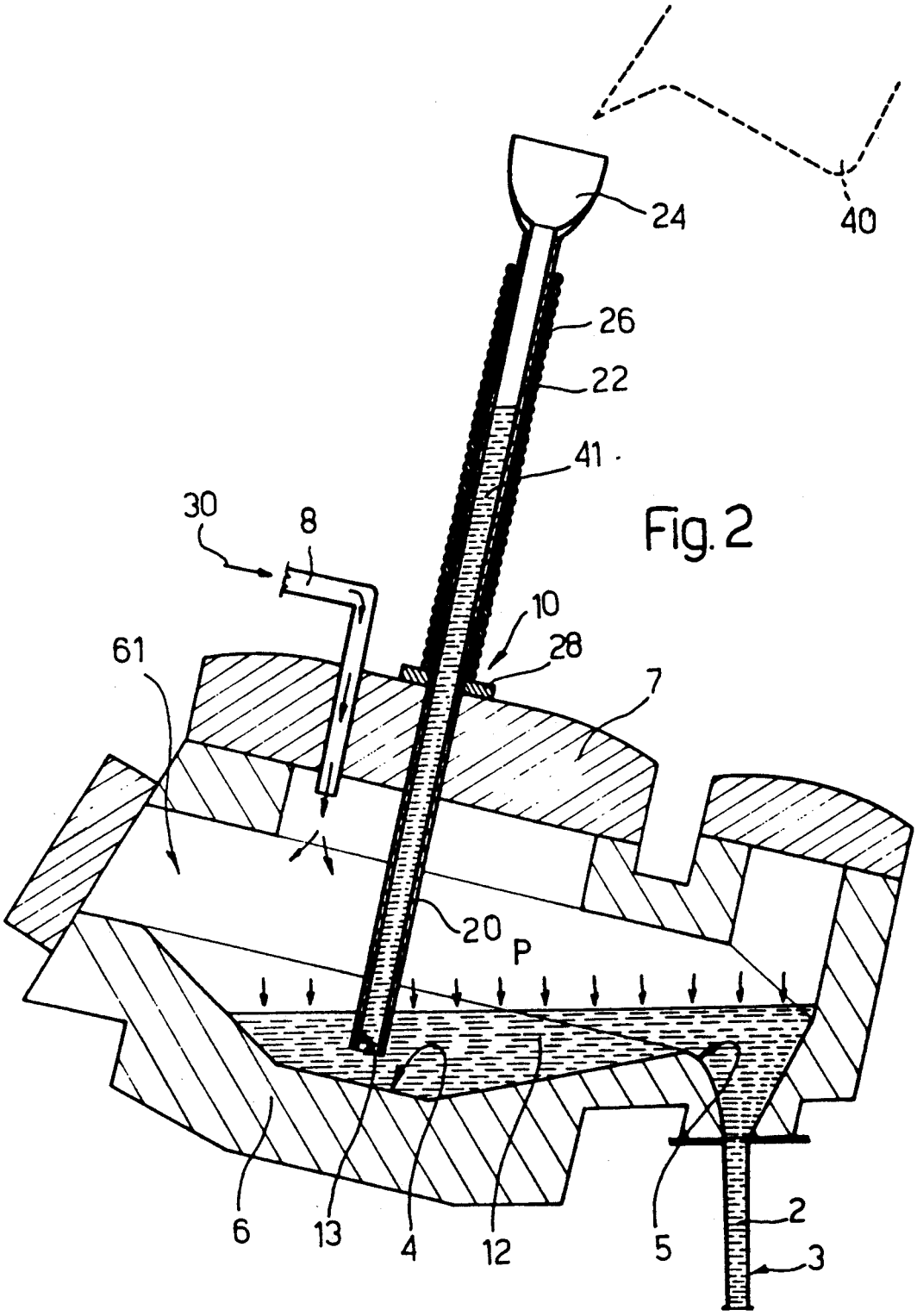
FIG. 2 schematically illustrates the casting process which can be performed with the furnace of FIG. 1.

With reference to FIGS. 1 and 2 the reference 1 indicates a furnace for casting a metal alloy 2 in a semi-liquid state, in particular for casting a light alloy, by passing this through a static mixer 3 of known type, illustrated only schematically as a cylindrical tube; the furnace 1, which is internally clad with a known refractory lining, not illustrated for simplicity, comprises a body 6 in the bottom of which are formed, in adjacent positions, a refractory monolithic lining material 4 and a casting aperture 5 connected, with a fluid-tight seal, to a static mixer 3, which is fixed to the body 6 in question immediately beneath the casting aperture 5; above the refractory monolithic lining material 4 and the casting aperture 5, which defines a lower portion of the furnace 1, the body 6 delimits a chamber 61 defining the upper portion of the furnace 1 and housing, in a known manner not illustrated for simplicity, suitable heating means, for example electrical resistances. The chamber 61 is closed in a fluid-tight manner by a cover 7 traversed by a tube 8 and, according to the invention, by a barometric column 10 of predetermined height surmounting the furnace 1 and dipping into the interior of the monolithic refractory lining 4; this latter is adapted to contain, in use, a fluid bath 12 of the metal alloy 2 of a height such as to ensure the immersion within it of a lower end 13 of the barometric column 10; the furnace 1 is of the rocking type and is therefore adapted to be inclined in use, during the casting stage, by a predetermined angle such as to cause displacement of the fluid bath 12 of alloy 2, by gravity, partially out from the monolithic refractory lining 4 to cover and fill the casting aperture 5, in such a way as to permit the fluid alloy 2 to flow out from the furnace 1 itself, by gassing through the casting aperture 5 and, from there, through the static mixer 3 connected fixedly to it; the barometric column 10 is disposed in a position such as to remain always immersed, even in this inclined configuration of the furnace 1, in the fluid bath 12 and, therefore, once inclined, the furnace 1, with the refractory monolithic lining filled with fluid alloy 2 is sealed in a fluid-tight manner from the external environment, communicating with the outside only through the tube 8; this is normally connected in a known manner not illustrated for simplicity with a source of pressurised, preferably inert gases, such as argon or nitrogen, in such a way that the interior of the furnace 1 can be pressurised to any predetermined pressure value by introducing a flow of the said pressurised gas into its interior through the tube 8.

In accordance with the invention the barometric column 10 comprises a first tube 20 made of graphite and disposed within the furnace 1, fixed so as to pass through the cover 7 and traversing the chamber 61 to terminate within the interior of the monolithic refractory lining 4 close to the bottom wall of this, and a second tube 22 surmounting the cover 7 outside the furnace 1 and provided with a funnel shaped upper end 24; this second tube 22 is provided externally with heating means defined, in the specific example, by an electrical resistance 26 wound helically around it, and is connected at its end, in a fluid-tight manner, to the first tube 20 by means of a flanged joint 28 disposed in correspondence with the cover 7. In this way the barometric column 10 is able to contain the alloy 2 in the fluid state within its interior.

According to the process of the invention, the furnace 1 is charged with a predetermined quantity of fluid alloy 2 equal to the capacity of the furnace (for example 500 Kg) in a conventional manner and, then, it is closed and assumes the conditions illustrated in FIG. 1; the furnace 1 is then inclined bringing it into the position of FIG. 2, in such a way as to cover the casting aperture 5 with the fluid bath 12 and at least partially to fill the static mixer 3; in this condition casting has not yet started in that the furnace 1 is dimensioned and disposed in such a way that the head of fluid alloy 2 which is created above the mixer 3 is negligible and insufficient to overcome, on its own, the pressure drop which the alloy 2 experiences in the partial solidification stage in passage through the mixer 3. This head of fluid alloy 2 has in fact only the purpose of putting the barometric column 10, which is immersed in a fluid-tight manner in the bath 12, into hydraulic, sealed, communication with the static mixer 3, which is covered and at least partially filled by the fluid bath 12. Subsequently the interior of the furnace 1 is pressurised by the introduction into an upper portion thereof not occupied by the fluid bath 12, in the specific example the chamber 61, by a flow of inert gas 30, indicated by the arrows (FIG. 2); this flow of gas brings the interior of the furnace 1 up to a pressure P greater than the value of the pressure drop associated with the passage of fluid alloy 2 through the mixer 3 and causes casting to commence: the alloy 2 flows from the aperture 5 and passes through the mixer 3; according to the invention, during this phase, the alloy 2 is carried (for example by suitably adjusting its rate of flow by adjustment of the pressure P, regulating its temperature as it leaves the furnace 1 by regulating the said heating means in the chamber 61, and regulating its exit temperature from the mixer 3, along which the alloy 2 experiences a cooling) in conditions such as to produce the segregation within the body of the liquid alloy of a solid phase (not illustrated for simplicity); moreover, the passage of the fluid alloy 2 through the static mixer 3 causes, as described in Italian Pat. No. 1,119,287 cited above, a uniform mixing of the solid phase upon formation with the liquid alloy 2 in such a way as to obtain at the output from the mixer 3 a temporarily stable suspension, or rather a suspension which is stable for a sufficient time for its use for the production of castings of the desired shape and dimensions. As described in the Patent cited above, the suspension at the output from the mixer 3 is collected for use, for example by suitable ladles not illustrated, only when the fluid-dynamic conditions of the alloy 2 along the mixer 3 are stationary, that is as soon as the initial casting transients have terminated.

According to the invention, for the purpose of indefinitely extending the casting once the stationary conditions have been reached, the rate of flow of alloy 2 which leaves the furnace 1 through the mixer 3 is balanced by an equal flow of new liquid alloy 2, which is introduced to the interior of the pressurised furnace 1, without reducing the pressurisation thereof, or rather by maintaining the interior of the furnace 1 sealed, through the barometric column 10; for example, the liquid alloy 2 is introduced in a discrete manner by pouring a predetermined quantity of it at intervals from a ladle 4 into the funnel 24 in such a way as to form and maintain within the barometric column 10 a head 41 of molten metal alloy of height such as to overcome the pressure P within the interior of the furnace 1. This fluid head 41 forms partially, thanks to the presence of the barometric column 10 and its immersion in the fluid bath 12 upon pressurisation of the furnace 1 by the flow of inert gas 61; the pressurisation P, which acts on the surface of the fluid bath 12, in fact urges into the barometric column 10, according to the well known laws of fluid statics, a part of the fluid alloy 2 forming the bath 12 until it forms a fluid head of height such as to balance the pressure P; the introduction of new alloy 2 through the funnel 24 causes an increase in the height of the fluid column present in the barometric column 10, with the formation of the head 41 which has a height such as to permit a part of the alloy contained in the column 10 to descend into the interior of the furnace 1 in such a way as to maintain substantially constant the quantity of alloy 2 which forms the fluid bath 12. Since this latter presents a very much greater surface than the section of the column 10, furthermore, this introduction of new fluid alloy 2 takes place without altering the stationary conditions of efflux of the alloy 2 through the casting aperture 5 in that upon writing the Bernoulli equation for the alloy 2 at the base of the column 10 it is easy to understand that the energy velocity component at this point is zero. For the purpose of compensating the dissipation of heat which can take place in the column 10 and thus permit the alloy 2 remaining in it to stay fluid even for relatively long periods of time the part of the column 10 which is outside the furnace 1, that is the tube 22, is heated from the outside by the resistance 26 during the whole of the casting operation; the part of the column 20 within the furnace, that is the tube 20, does not need suitable heating since it is heated by radiation from the heating means within the furnace 1.

Finally, according to the process of the invention, the value of the pressure P is chosen in such a way as to make the alloy 2 flow through the static mixer 3 in rigorously laminar conditions so that the mixer 3 can operate correctly.

From what has been described the advantages connected with the invention are evident; thanks to a furnace of very simple structure, which is easy to operate and control, and of economic construction, the casting operation which, according to the state of the art was only possible in a discontinuous manner, can be made continuous entirely without loss of the particularly beneficial microstructural characteristics of the material subjected to treatment through the mixer 3. The possibility of performing continuous casting, which can continue for tens of hours, moreover, makes it possible to reduce to the minimum or even to eliminate entirely the necessity for maintenance of the mixer 3; bearing in mind that this is in any case subject to an inevitable wear so that it must be replaced after a certain number of castings, it is possible to design static mixers 3 having dimensions such as to offer a durability equal to that of an individual continuous caster; the process of the invention therefore makes it possible to utilise "disposable" mixers thus eliminating any necessity for maintenance of the casting installation save for the ordinary maintenance of the refractory lining of the furnace 1.

What is claimed is:

1. A process for continuous casting in the semi-liquid state in stationary conditions, said process comprising the following steps:

introducing a molten alloy into a furnace and closing the furnace in a fluid-tight manner;

discharging the alloy from the furnace through a static mixer placed outside the furnace and hydraulically connected thereto;

pressurizing the interior of the furnace to cause segregation of the alloy passing through the static mixer into a solid phase within the body of the liquid alloy so the solid phase upon formation is mixed uniformly with the liquid alloy and a temporarily stable suspension of the solid phase in the liquid alloy at the output from the static mixer is provided; and supplying further liquid alloy to the furnace via a barometric column extending into the interior thereof, maintaining pressure in the interior of the furnace to balance the pressure exerted by the liquid alloy contained in the barometric column and to balance the quantity of liquid alloy fed out of the furnace and passed through the mixer for producing said suspension, so as to continuously feed the static mixer through the barometric column via the interior of the furnace;

whereby said liquid alloy and said solid phase suspended therein flow through the mixer in stationary laminar conditions.

2. The process of claim 1, wherein the alloy is introduced into the furnace in a discrete manner by pouring a predetermined quantity contained in a ladle into the barometric column so as to form within the interior of the barometric column a head of molten metal alloy of height so as to overcome the pressure within the interior of the furnace, the barometric column being heated externally at least over its section disposed outside the furnace.

3. The process of claim 1, wherein said step of supplying further liquid alloy includes inclining the furnace so as to put the barometric column and the static mixer in hydraulic communication in a fluid-tight sealed manner through a fluid bath formed by the alloy and contained within a lower portion of the furnace, and said pressurising step includes introducing a flow of inert gas into an upper portion of the furnace not occupied by the fluid bath.

* * * * *